US006227117B1

(12) United States Patent
Peltier et al.

(10) Patent No.: US 6,227,117 B1
(45) Date of Patent: May 8, 2001

(54) RETAINING DEVICE, ESPECIALLY FOR THE REAR IGNITER OF A MISSILE

(75) Inventors: Guy Peltier, Verrieres le Buisson; Paul Goillot, Boissy Saint Leger; André Gouthiere, Chatillon; Gérard Koenig, Velizy, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/170,279

(22) Filed: Oct. 13, 1998

(30) Foreign Application Priority Data

Oct. 20, 1997 (FR) ..... 97 13097

(51) Int. Cl.[7] ..... F42B 4/00; F41F 3/055

(52) U.S. Cl. ..... 102/347; 89/1.811; 244/121

(58) Field of Search ..... 102/347, 380, 102/202; 89/1.807, 1.813, 1.701, 1.811, 36.06, 36.07; 244/63, 121

(56) References Cited

U.S. PATENT DOCUMENTS

| | | | | |
|---|---|---|---|---|
| 2,734,425 | * | 2/1956 | Brandt | 89/36.06 |
| 2,776,623 | * | 1/1957 | Bonner | 60/256 |
| 3,194,119 | * | 7/1965 | Robert et al. | 89/1.814 |
| 3,398,639 | * | 8/1968 | Apotheloz | 89/1.806 |
| 3,674,227 | * | 7/1972 | Jacobson et al. | 244/121 |
| 3,811,360 | * | 5/1974 | Ricks | 89/1.807 |
| 4,022,343 | * | 5/1977 | Richardson | 206/521 |
| 4,426,909 | | 1/1984 | Carter . | |
| 4,522,103 | * | 6/1985 | Mitzner | 89/1.811 |
| 4,676,136 | | 6/1987 | Kälin . | |
| 5,078,044 | | 1/1992 | Bourgie et al. . | |
| 5,491,917 | | 2/1996 | Dilhan et al. . | |

FOREIGN PATENT DOCUMENTS

| | | | | |
|---|---|---|---|---|
| 1254509 | * | 11/1967 | (DE) | 102/347 |
| 1.336.054 | | 12/1963 | (FR) . | |
| 2 685 463 | | 6/1993 | (FR) . | |
| 996829 | * | 6/1965 | (GB) | 89/1.807 |

* cited by examiner

*Primary Examiner*—Peter M. Poon
*Assistant Examiner*—Son T. Nguyen
(74) *Attorney, Agent, or Firm*—Oblon, Spivak, McClelland, Maier & Neustadt, P.C.

(57) ABSTRACT

A device for retaining an element ejected by a pyrotechnic device when it is fired comprises at least one metal cap placed behind the nozzle of the device and designed to receive the ejected element, the cap being held in position by curved rigid links. The kinetic energy of the captured element carries along the cap and the captured element and the motion of the assembly is braked by the deformation of the rigid links. Application especially to the retaining of the rear igniter of a missile.

25 Claims, 3 Drawing Sheets

RETAINING DEVICE, ESPECIALLY FOR THE REAR IGNITER OF A MISSILE

BACKGROUND OF THE INVENTION

1. Field of the Invention

The present invention relates to a device for retaining an element ejected by a pyrotechnic device when it is triggered. It can be applied especially to the retaining device of the rear igniter of a missile. More generally, it can be applied to any pyrotechnic device with rear ejection of elements such as the igniter, the explosive bolt, the booster, the skids or the lids.

During the phase of the firing of a pyrotechnic device such as the engine of a missile for example, the igniter of the engine is ejected at high speed backwards and has kinetic energy such that the ejection may cause very great harm to human beings and extensive damage to equipment.

2. Description of the Prior Art

To obtain protection from the elements that are thrown out, it may be planned to have a system external to the ammunition known as a system "on the launch pad". However, a system of this kind has many drawbacks. One example, among others, of drawbacks arises especially out of the fact that the launch pad cannot be too close to the rear of the device. Since they are relatively distant, the elements strike the launch pad with a kinetic energy that is all the greater. Consequently, the launch pad needs to have a sufficiently great mass for more material is needed to absorb the energy. This fact then leads to great complexity in the control servo-mechanisms of the launch pad. Furthermore, the relative distance of the launch pad does not always ensure that the elements thrown out will be captured in a reliable way.

Another approach may for example consist in eliminating the ejection. To prevent rear ejection from a pyrotechnic device, it is possible to ignite its engine from the front. In this case, the pyrotechnic elements are integrated during the assembling of the missile, entailing the risks associated with the handling and the in-plant testing of primed explosive elements.

The positioning of the igniter in the rear of the engine during the final phase of integration minimizes the pyrotechnical risks, especially risks in the plant, but leads to the ejection of the igniter at the firing stage. In addition to the flame effects, the structures located in the rear of the firing line receive, as mentioned here above, the projectiles that are constituted by the ejected elements. Given their high speed, which is greater than 100 m/s, these elements may possess kinetic energy of several hundreds of Joules. These projectiles may therefore cause major damage to neighboring structures or even cause injuries to operators, even if they are shielded, especially owing to the risks of ricochets that are impossible to control.

To prevent the risks associated with pyrotechnic devices of this kind during the firing stage while at the same time keeping the advantages associated with rear firing without using the launch pad to receive the ejected elements, it is necessary to capture these elements by means of a retaining device fixedly joined to the container of the device. In the case of application to a missile for example, the capturing device must in particular correspond to the following requirements:

- the pyrotechnic elements should be captured and held captive during the phase of departure of the missile, namely for a time interval of about 0.2 seconds;
- the nozzle and the rear of the missile should be released from the missile at high speed, for example within less than 5 ms, to a distance of about 100 mm, but the movement should remain compatible with the templates chosen;
- the capturing device should not cause deterioration or disturbances that might lead to a defective launch, and furthermore the retaining forces should be compatible with the capacities of compensation of the servo-mechanisms of the missile-launching turret;
- the capturing device should be capable of withstanding the environmental stresses of the ammunition, namely those of the missile and container.

SUMMARY OF THE INVENTION

The aim of the invention is to enable the making of a device that corresponds especially to the above requirements. To this end, an object of the invention is a device for retaining an element ejected by a pyrotechnic device wherein said device comprises at least one metal cap placed behind the nozzle of the device and designed to receive the ejected element, the cap being held in position by curved rigid links, the kinetic energy of the ejected element carrying along the cap and the captured element, the motion of the assembly being braked by the deformation of the rigid links.

The main advantages of the invention are the following: it can be used to obtain a device in the form of a kit that is set so that it is ready to be used, the device can be mounted on a missile during the final integration of the pyrotechnic elements, it can work under very harsh conditions and has very great operating safety, it can be mounted on a missile or any other pyrotechnic device that is already made but has not been fitted out with a retaining system and the making and assembly of the device are economical.

BRIEF DESCRIPTION OF THE DRAWINGS

Other features and advantages of the invention shall appear from the following description made with reference to the appended drawings, of which.

MORE DETAILED DESCRIPTION

Figure 1:
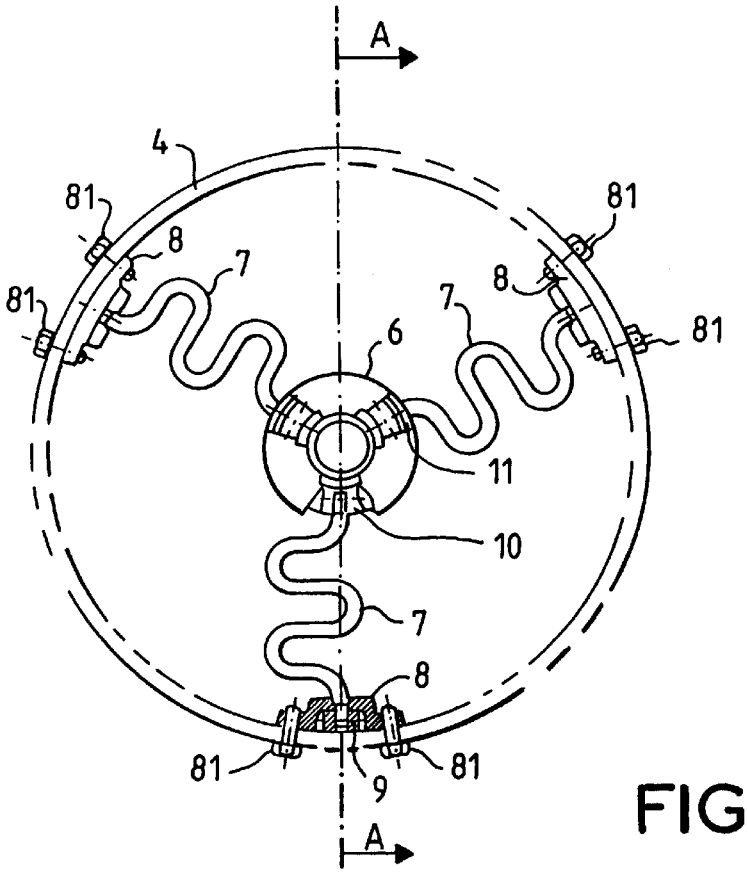
FIG. 1 shows a possible exemplary embodiment of a device according to the invention.
Figure 2:
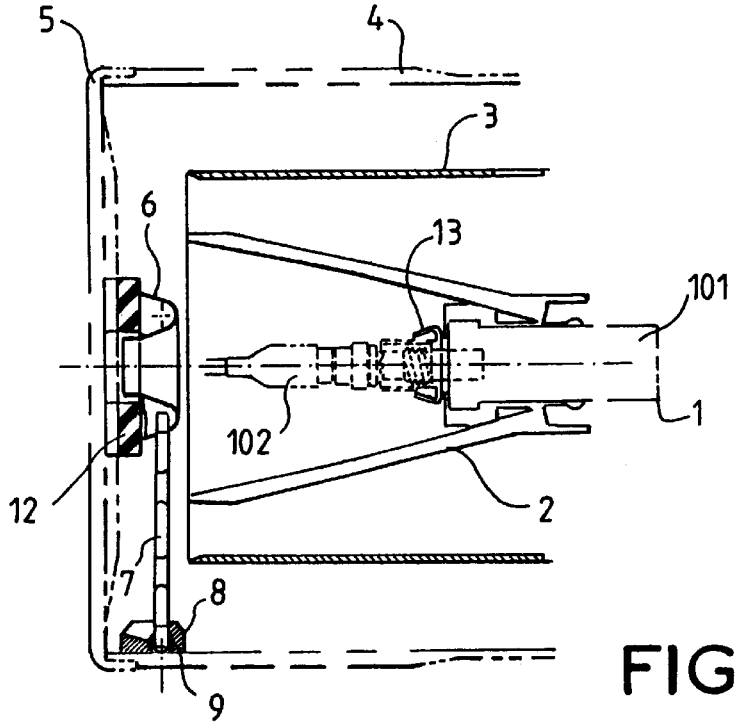
FIG. 2 shows the above exemplary embodiment in a view along AA of FIG. 1 associated with the elements of a pyrotechnic device.

FIGS. 1 and 2 show a possible exemplary embodiment of a device according to the invention to retain the igniter 1 of a pyrotechnic device 3, for example a missile, during the firing phase. The igniter actually has, firstly, a part 101 that melts during its operational phase. This part is the pyrotechnic charge of the igniter. The igniter has, secondly, a solid part comprising essentially its connector 102 through which it is connected by a cable (not shown) to the general connector of the missile. It is through this cable and this connector 102 that the firing command is transmitted. The part of the igniter that is ejected is actually the part of the igniter that remains solid since its pyrotechnic charge 101 is consumed for the firing. The igniter 1 is generally ejected with a speed of over 100 m/s and hence with very great energy. Hereinafter, the pyrotechnic device considered is, for example, the engine of a missile.

A device according to the invention comprises a metal cap 6 placed behind the outlet of the nozzle 2 of the missile 3. The cross-section of the missile and the cap are substantially concentric. The cap 6 is designed especially to receive the igniter 1 during its ejection backwards. A shock-absorbing buffer 12 is used for example as a strap between the cap 6 and the rear hood 5 of the missile container 4. The cap is held in position by means of curved rigid links 7, which for example are made of metal. These curved links have for example the shape of serpentine coils. They are for example three in number. Hereinafter, reference shall be made to serpentine coils but any other shape of curved lines is possible. The serpentine coils are made of a material which in particular withstands great heat due especially to the flame effect. A serpentine coil 7 is connected to the container 4 by a support 8. The fastening of a support to the container is done for example by screws 81. The impervious sealing of this fastening is obtained by bonding identical to the other tight-sealing fixtures of the container.

When the missile 3 is launched, the arrival of the igniter 1 in the cap 6 causes the rear hood 5 to break and releases the deployment of the retaining device according to the invention. The kinetic energy of the igniter 1 and the pressure of the gases coming from the nozzle 2 carry along the cap 6 and the igniter 1 captured by this cap 6. The motion of the assembly is hampered by the deformation of the serpentine coils 7 which stretch during this motion. The curved shape of the serpentine coil means that it can work only under traction during deployment, thus preventing rupture under bending forces. The material of the serpentine coil however has low rupture strength so as to obtain the greatest possible stretching. To this end, the serpentine coils are made for example of soft steel.

Each serpentine coil 7 works together with the cap 6 and with its support 8 on the container by hinges which minimize the risks of parasitic bending forces, hence the risks of breakage through these bending forces. To this end, a serpentine coil is articulated by trunnions 9, 10 at its support 8 and the cap 6. Consequently, during the deployment of the serpentine coils 7, they are hinged in a rotational motion with respect to the cap and the support without any risk of breaking under bending forces, since the rotational motions enable them to extend substantially in parallel to the thrust caused by the ejection of the igniter and by the gases. The hinging trunnions 9, 10 are for example tapped perpendicularly to their axis of rotation, the ends of the serpentine coils being then screwed into these holes. For a serpentine coil 7, the trunnion 9 of the first hinge oscillates in the support 8 fixed to the container and the trunnion 10 of the second hinge oscillates in a nut 11 wedged into the cap 6 on the side of the cap opposite the igniter 1. These oscillations are done along an axis that is substantially perpendicular to the tangent to the rigid link 7 at the meeting point of this link with the trunnions.

Figure 3:
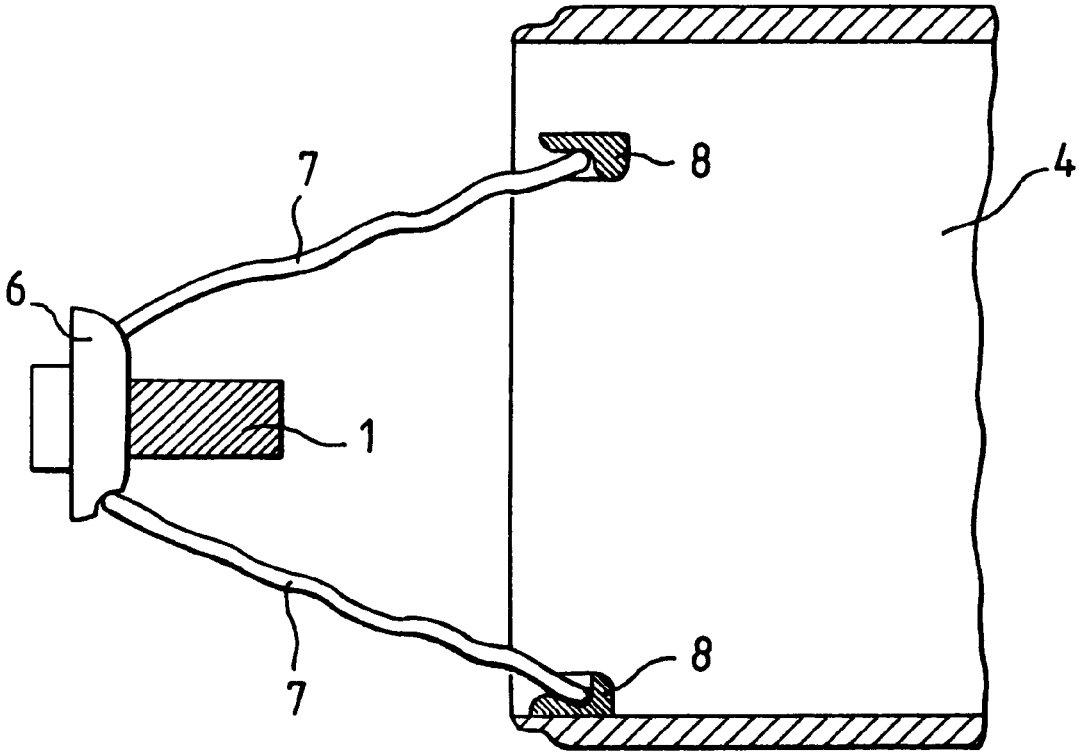
FIG. 3 shows a device according to the invention in a deployed position.

FIG. 3 shows a device according to the invention as described with reference to FIGS. 1 and 2 in a deployed position, once the firing is over. The igniter 1 has been captured by the cap 6. The serpentine coils, of which two out of three have been shown, are in their elongated position. The igniter is retained by the cap 6 and the serpentine coils 7 which are themselves fixedly joined to the container 4 by means of their hinge on the supports 8.

FIG. 2 shows that the connector 102 of the igniter is for example fitted out with a bell 13 designed to cushion the shock of arrival of the igniter 1 on the cap 6. To increase the cushioning effect, the bell is for example split. The bell 13 furthermore helps to guide and keep the igniter 1 in the cap and thus to prevent rebounds. The transmission cable for the igniting command (not shown) connecting the connector of the igniter to the general connector of the missile passes for example through the cap to further facilitate the guidance of the connector 102 of the igniter in the cap 6.

Figure 4:
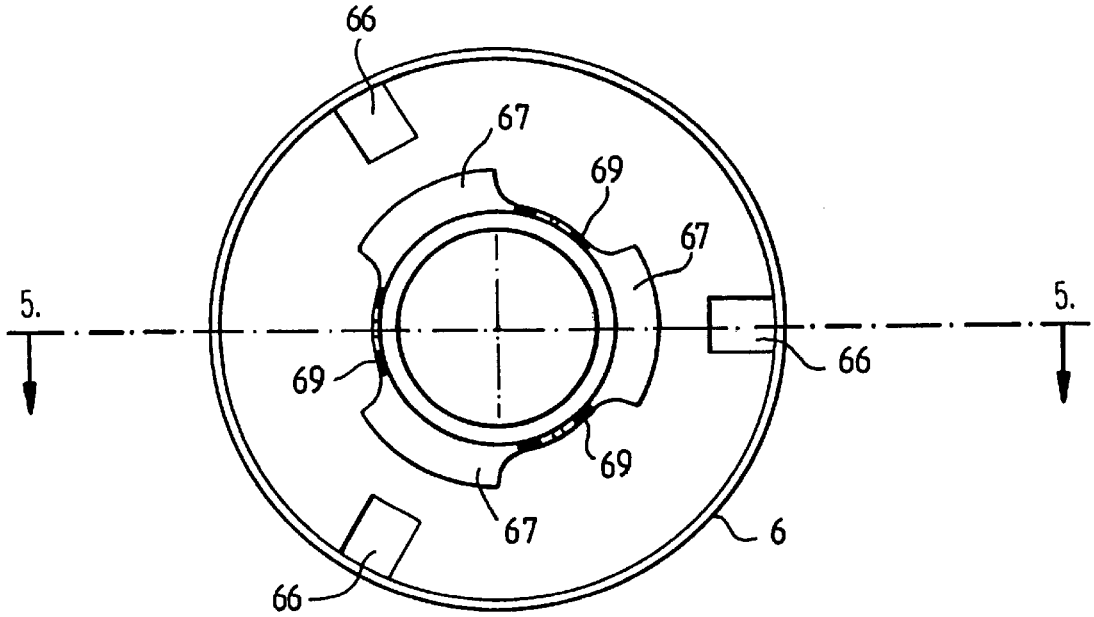
FIG. 4 shows a possible exemplary embodiment of a cap used in a device according to the invention.
Figure 5:
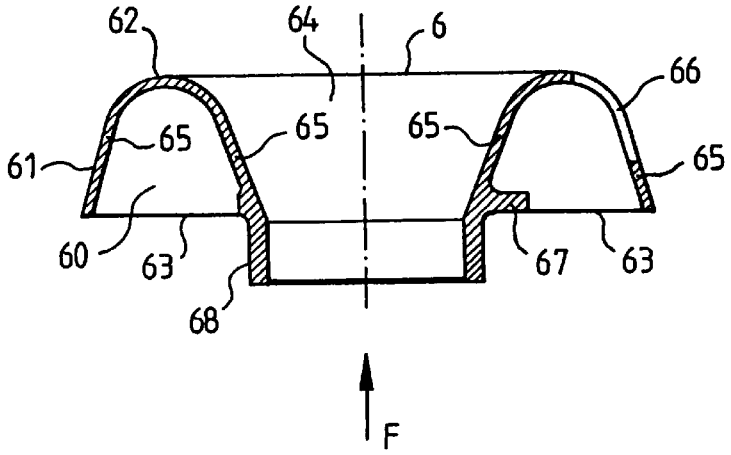
FIG. 5 shows the above exemplary embodiment in a view along BB of Figure.

FIGS. 4 and 5 show an exemplary embodiment of the cap 6. FIG. 5 is a sectional view along BB of FIG. 4. This FIG. 4 is a view along F of FIG. 5. The shape of the cap makes it possible in particular to facilitate capture and the holding of the igniter during the deployment phase. Its shape furthermore has aerodynamic properties designed to minimize drag stresses. Furthermore, while it is nevertheless simpler to make a solid part, a cap shape, namely a hollow shape 60 generated by revolution, with its aperture opposite the igniter 1, has been adopted so as to optimize the weight of the cap. For the weight of the cap should not be so great that it gets released rapidly.

The cap has a shape with a symmetry of revolution and furthermore has an internal funnel shape 64 to receive the igniter 1. The section 61 of the cap has a rounded summit 62 facing the igniter 1. A cylindrical part 68 extends beyond its base 63 opposite its summit 62 in the form of an end of the funnel 64. This in particular makes the holding of the igniter 1 in the cap 6 more reliable. The sections 65 of the cap 6, which go from the base 63 to the summit 62, are for example rectilinear.

The cap 6 has apertures 66 to enable the passage of the serpentine coils 7 and, more particularly, the passage of the ends of the serpentine coils fastened to the trunnions 10 of the hinges. A ring 67 which surrounds for example the above-mentioned cylindrical part 68 of the cap is used in particular to block the nuts 11 which work together with the trunnions 10. The ring 67 has recessed portions 69 to let through the nuts 11 which are thereafter blocked between the inner face of the cap and the wide parts of the ring 67. The mounting of a nut 11 and then of a serpentine coil 7 can then for example be done by placing the nut between the ring 67 and the inner face of the cap, in making its tapped hole face the aperture 66 of the cap and then screwing the end of the serpentine coil 7 into this tapped hole through the aperture 66. Furthermore, the nut 11 provides for the efficient tight-sealing of the hinges. This makes it possible in particular to prevent a so-called chimney effect, namely the passage of the flame during the firing. This therefore prevents local melting and enables retention in the flame of the engine for a duration of over 200 ms. The thickness of the section 61 of the cap makes it possible both to minimize its weight so that it is swiftly released as indicated here above and to give it mechanical and thermal strength. To this end, the cap which is made of steel has a thickness, for example, of about 1 millimeter. The cap is made, for example, of stainless steel with high mechanical characteristics.

The device according to the invention can be used under severe conditions. In particular, with regard for example to mechanical shocks of docking with and of the departure of other missiles, or with regard to vibrations in transportation, mechanical strength is obtained by maintaining the cap 6 by means of serpentine coils 7. The serpentine coils are, to this end, slightly tensioned and they abut the supports 8 fixed to the container 4. The shock-absorbing buffer 12 complements the holding action while at the same time damping the vibrations. The choice of the materials of the components of a device according to the invention furthermore enables it to withstand corrosive gases or heat shock.

A device according to the invention furthermore has great security of operation, especially through the tight sealing of certain parts, for example at the hinges as described here above, through the fact that it is rapidly released from the outlet of the nozzle as well as its great geometrical deformation which moves the retained element to a relatively great distance away from the nozzle.

A device according to the invention can be delivered in the form of a kit so that it is installed especially on missiles already integrated into operational containers or batteries. More generally, it may be mounted on any missile or any pyrotechnic device already made but not provided with a retaining system. A kit comprises for example a set formed of serpentine coils 7 hinged around the cap 6 and the supports 8. These supports 8 are designed for example to be fixed to the container of a missile. The kit furthermore comprises for example a shock-absorbing buffer 12 and a bell 13. Since the kit is set in the plant, its installation may be done by drilling the tube of the container in particular to affix the supports 8 of the serpentine coils and then by bonding the rear hood and the sealing fixtures. An operation of this kind requires only a few minutes. It is therefore not costly.

The device according to the invention has been described by way of an example for the retaining of an igniter. However, it can be applied to other elements ejected by pyrotechnic devices such as for example explosive bolts or boosters.

What is claimed is:

1. An element retaining device for retaining an element ejected by a pyrotechnic device when the pyrotechnic device is fired, said element retaining device comprising:

at least one metal cap placed adjacent to a nozzle of the pyrotechnic device, said at least one metal cap being designed to receive the element ejected by the pyrotechnic device;

a plurality of rigid links attached to said at least one metal cap, wherein the element ejected by the pyrotechnic device possesses an amount of kinetic energy so that the element ejected by the pyrotechnic device carries along said at least one metal cap therewith, the kinetic energy of the element ejected by the pyrotechnic device being dampened so that a motion of the element ejected by the pyrotechnic device comes to a stop upon deformation of said plurality of rigid links.

2. The element retaining device according to claim 1, wherein each rigid link of said plurality of rigid links has a serpentine shape.

3. The element retaining device according to claim 1, wherein each rigid link of said plurality of rigid links has a low rupture strength.

4. The element retaining device according to claim 3, wherein each rigid link of said plurality of rigid links is made of soft steel.

5. The element retaining device according to claim 1, wherein said at least one metal cap is held by three rigid links.

6. The element retaining device according to claim 1, wherein, with the pyrotechnic device being placed in a container, a shock-absorbing buffer is placed between said at least one metal cap and a hood of the container.

7. The element retaining device according to claim 1, wherein said at least one metal cap and a section of the pyrotechnic device are substantially concentric.

8. The element retaining device according to claim 1, wherein, with the pyrotechnic device being placed in a container, at least one rigid link of said plurality of rigid links is connected to the container by a support, said at least one rigid link cooperating with said support via a trunnion oscillating in said support, oscillations of said trunnion taking place along an axis that is substantially perpendicular to a tangent to said at least one rigid link at a point where said at least one rigid link and said trunnion meet.

9. The element retaining device according to claim 8, wherein an end of said at least one rigid link is screwed into a tapped hole made in said trunnion, said tapped hole being substantially perpendicular to an axis of rotation of said trunnion.

10. The element retaining device according to claim 1, wherein at least one rigid link of said plurality of rigid links cooperates with said at least one metal cap via a trunnion oscillating in a nut that is fixedly joined to said at least one metal cap, oscillations of said trunnion taking place along an axis that is substantially perpendicular to a tangent to said at least one rigid link at a point where said at least one rigid link and said trunnion meet.

11. The element retaining device according to claim 10, wherein an end of said at least one rigid link is screwed into a tapped hole made in said trunnion, said tapped hole being substantially perpendicular to an axis of rotation of said trunnion.

12. The element retaining device according to claim 10, wherein said at least one metal cap has an aperture to let through said end of said at least one rigid link.

13. The element retaining device according to claim 10, wherein a ring is used to block said nut which cooperates with said trunnion.

14. The element retaining device according to claim 13, wherein said ring has recessed features to enable passage of said nut when said nut is being mounted.

15. The element retaining device according to claim 1, further comprising a bell fitted into the element ejected by the pyrotechnic device, said bell being designed to cushion a shock of arrival of the element ejected by the pyrotechnic device at said at least one metal cap.

16. The element retaining device according to claim 15, wherein said bell is split.

17. The element retaining device according to claim 1, wherein said at least one metal cap has a hollow shape and includes an aperture opposite to the element ejected by the pyrotechnic device.

18. The element retaining device according to claim 1, wherein said at least one metal cap has an internal funnel shape.

19. The element retaining device according to claim 18, wherein said at least one metal cap has a cylindrical part beyond a base thereof said cylindrical part forming an ending to said internal funnel shape of said at least one metal cap.

20. The element retaining device according to claim 1, wherein a section of said at least one metal cap has a rounded summit facing the element ejected by the pyrotechnic device.

21. The element retaining device according to claim 20, wherein said at least one metal cap has sections from a base thereof to a summit thereof said sections being rectilinear.

22. The element retaining device according to claim 1, wherein, with the pyrotechnic device being placed in a container, each rigid link of said plurality of rigid links are slightly tensioned and each rigid link of said plurality of rigid links is associated with a support so that each rigid link of said plurality of rigid links abuts said support associated therewith and fixed to the container.

23. The element retaining device according to claim 1, wherein the element ejected by the pyrotechnic device is an igniter.

24. The element retaining device according to claim 23, wherein a transmission cable for the igniter passes through said at least one metal cap.

25. The element retaining device according to claim 1, wherein the pyrotechnic device is an engine of a missile.

* * * * *